US011079120B2

(12) United States Patent
Zhou et al.

(10) Patent No.: US 11,079,120 B2
(45) Date of Patent: Aug. 3, 2021

(54) AIR HANDLING UNIT

(71) Applicant: TRANE INTERNATIONAL INC., Davidson, NC (US)

(72) Inventors: Longmei Zhou, Shanghai (CN); Bartley Hendley, Davidson, NC (US); Daniel A. Dees, Davidson, NC (US); Thomas A. Ley, La Crosse, WI (US); Zach M. Gamache, Davidson, NC (US); Mingxun Wu, Jiangsu (CN)

(73) Assignee: TRANE INTERNATIONAL INC., Davidson, NC (US)

( * ) Notice: Subject to any disclaimer, the term of this patent is extended or adjusted under 35 U.S.C. 154(b) by 169 days.

(21) Appl. No.: 16/336,563

(22) PCT Filed: Sep. 26, 2016

(86) PCT No.: PCT/CN2016/100184
§ 371 (c)(1),
(2) Date: Mar. 26, 2019

(87) PCT Pub. No.: WO2018/053860
PCT Pub. Date: Mar. 29, 2018

(65) Prior Publication Data

US 2020/0025395 A1 Jan. 23, 2020

(51) Int. Cl.
*F24F 1/005* (2019.01)
*F24F 13/20* (2006.01)
(Continued)

(52) U.S. Cl.
CPC ..... *F24F 1/005* (2019.02); *F24F 13/20* (2013.01); *F24F 8/28* (2021.01); *F24F 13/222* (2013.01); *F24F 13/28* (2013.01); *F24F 13/30* (2013.01)

(58) Field of Classification Search
CPC ..... F24F 1/005; F24F 13/20; F24F 13/222; F24F 13/28; F24F 13/30; F24F 2003/1678
(Continued)

(56) References Cited

U.S. PATENT DOCUMENTS 3,299,660 A * 1/1967 Sullivan ..... F24F 1/0007 62/285
3,749,157 A 7/1973 Davison
(Continued)

FOREIGN PATENT DOCUMENTS

CN 201041386 Y 3/2008
CN 101975420 A 2/2011
(Continued)

OTHER PUBLICATIONS

International Search Report and Written Opinion; International Patent Application No. PCT/CN2016/100184, dated Jun. 29, 2017 (9 pages).

*Primary Examiner* — Steve S Tanenbaum
(74) *Attorney, Agent, or Firm* — Hamre, Schumann, Mueller & Larson, P.C.

(57) ABSTRACT

An AHU comprises a cabinet, a heat exchanger and a blower. The cabinet has an air inlet opening and an air outlet opening, panels are provided on sides of the cabinet forming an air flow path for air flowing through the air handling unit between the air inlet opening and the air outlet opening. The heat exchanger is disposed in the air flow path and adapted to conduct heat exchange between air passing through the air flow path and a working medium flowing in the heat exchanger. The heat exchanger includes an inlet header for supplying the working medium and an outlet header for collecting the working medium. The heat exchanger is
(Continued)

slanted with respect to a side of the cabinet such that the inlet header and the outlet header extend through one of the sides of the cabinet for providing access to the inlet header and the outlet header from the one of the sides of the cabinet. The blower is vertically disposed relative to the heat exchanger in the cabinet for forcing air to flow through the air flow path.

15 Claims, 11 Drawing Sheets

(51) Int. Cl.

| | |
|---|---|
| ***F24F 13/22*** | (2006.01) |
| ***F24F 13/28*** | (2006.01) |
| ***F24F 13/30*** | (2006.01) |
| ***F24F 8/28*** | (2021.01) |

(58) Field of Classification Search
USPC ..... 62/285
See application file for complete search history.

(56) References Cited

U.S. PATENT DOCUMENTS

| | | | | |
|---|---|---|---|---|
| 4,151,726 | A * | 5/1979 | Schlueter | F24F 13/22 62/285 |
| 4,462,460 | A | 7/1984 | Braver | |
| 5,308,037 | A | 5/1994 | Gonzalez | |
| 5,740,790 | A | 4/1998 | Lipsky | |
| 6,065,296 | A | 5/2000 | Feger | |
| 6,662,588 | B2 | 12/2003 | Houk et al. | |
| 7,065,978 | B2 | 6/2006 | Hong et al. | |
| 7,263,850 | B2 | 9/2007 | Eom et al. | |
| 7,601,204 | B2 | 10/2009 | Woodruff et al. | |
| 8,939,826 | B2 | 1/2015 | Zorzit et al. | |
| 8,948,576 | B2 | 2/2015 | Logan et al. | |
| 2010/0326624 | A1 | 12/2010 | Hancock | |
| 2011/0232860 | A1 | 9/2011 | Lackie et al. | |
| 2013/0017774 | A1* | 1/2013 | Zorzit | F24F 1/0007 454/239 |

FOREIGN PATENT DOCUMENTS

| | | | |
|---|---|---|---|
| CN | 103994496 | A | 8/2014 |
| CN | 204084617 | U | 7/2015 |
| CN | 105387606 | A | 3/2016 |

* cited by examiner

AIR HANDLING UNIT

FIELD

The embodiments described herein relate generally to heating, ventilation, and air conditioning systems (HVAC systems). More particularly, the embodiments described herein relate to an air handling unit (abbreviated to AHU) used in HVAC systems.

BACKGROUND

An AHU is a device used to regulate and circulate air as part of a HVAC system for use for example in a residential or commercial application. The AHU often contains a heat exchanger, a blower and other structural and electrical components disposed within a cabinet. A ductwork ventilation system is often connected with the AHU that distributes conditioned air through a residential or commercial environment and then returns the air to the AHU.

SUMMARY

A conventional AHU often contains a heat exchanger, a blower and other structural and electrical components disposed within multiple cabinets. The volumetric size of the AHU itself is typically large. Further, the AHU is often connected with piping lines, for example, for supplying a working medium such as refrigerant to the AHU, collecting and returning the working medium, for example, to a HVAC system. Drain lines are also often provided out of the AHU for draining off condensate generated on a cooling heat exchanger. These lines occupy more space. The AHU is often disposed in an enclosed environment, for example an application facility such as a room or a closet which provides limited space for the AHU and may have walls or other machines surrounding the AHU. Some components within the AHU need routine service, repair, or replacement over the life of the unit. For example, the heat exchanger should be periodically cleaned to maintain proper heat transfer. The more difficult it is to reach a component of the AHU, the less likely maintenance will be performed, which may result in low overall performance, efficiency and/or longevity.

An AHU disclosed herein includes features that allow a reduced footprint so that the AHU can fit into a compact space, and that allow users to access components within the AHU from one side of the cabinet of the AHU to conduct installation and service within the compact space.

According to an embodiment, an AHU comprises a cabinet, a heat exchanger and a blower. The cabinet has an air inlet opening and an air outlet opening, panels are provided on sides of the cabinet forming an air flow path for air flowing through the air handling unit between the air inlet opening and the air outlet opening. The heat exchanger is disposed in the air flow path and adapted to conduct heat exchange between air passing through the air flow path and a working medium flowing in the heat exchanger. The heat exchanger includes an inlet header for supplying the working medium and an outlet header for collecting the working medium. The heat exchanger is slanted with respect to one of the sides of the cabinet such that the inlet header and the outlet header extend through the one of the sides of the cabinet for providing access to the inlet header and the outlet header from the one of the sides of the cabinet. The blower is vertically disposed relative to the heat exchanger in the cabinet for forcing air to flow through the air flow path.

In an embodiment, the AHU may also include a motor for driving the blower. The blower and the motor are accessible from the one of the sides of the cabinet.

In an embodiment, the AHU may include a filter disposed in the air flow path through which air flows before flowing to the heat exchanger and the blower. The filter faces the one of the sides of the cabinet. This arrangement allows access to the filter for installment, service, etc. from the one of the sides of the cabinet.

In an embodiment, the AHU may include a drain pan in the cabinet that is elevated from a bottom side of the cabinet for collecting condensate generated in the heat exchanger. The AHU may further have a drain pipe in fluid communication with the drain pan that extends through the one of the sides of the cabinet for transporting condensate in the drain pan out of the cabinet through the one of the sides of the cabinet. In an embodiment, the drain pipe may further have a curved trap within the cabinet that is curved down for a height from the drain pan. The elevated drain pan provides space for accommodating the curved trap that is curved down from the drain pan. Thus, there is no need to provide such components as mounting legs and mounting feet as in conventional AHUs for elevating the heat exchanger from the bottom side of the cabinet for the purpose of providing a vertical space for accommodating the curved trap. Further, the drain pipe that extends through the one of the sides of the cabinet allows access to the drain pipe from the one of the sides of the cabinet.

In an embodiment, the AHU may include a control box that is disposed facing the one of the sides of the cabinet such that the control box is accessible from the one of the sides of the cabinet.

In an embodiment, the heat exchanger and the blower may be housed in one single cabinet that is one volume. In this manner, the structure of the AHU is simplified.

In an embodiment, the one of the sides may be a front side of the cabinet, and the cabinet may include a back side and opposing left and right side between the front side and the back side. The AHU may have a first frame. The first frame is slanted with respect to the front side of the cabinet. A first end of the first frame is removably attached to the left side and the right side, a second end of the first frame is removably attached to the drain pan, and a front side of the heat exchanger with respect to the front side of the cabinet is supported by the first frame. In an embodiment, the first frame is slanted such that the first end of the first frame is an upper front end with respect to the front side of the cabinet, and the second end of the first frame is a lower back end with respect to the back side of the cabinet.

In an embodiment, the AHU may further have a second frame. The second frame is attached to the left and/or right side of the cabinet, and a back side of the heat exchanger with respect to the back side of the cabinet is supported by the second frame.

In an embodiment, the AHU may further have a third frame for suspending the heat exchanger above the drain pan. The third frame is slanted with respect to the bottom side of the cabinet.

In an embodiment, the heat exchanger may include eight rows of coil. In another embodiment, the heat exchanger further includes a first heat exchanger and a second heat exchanger. The first heat exchanger further has a first inlet header and a first outlet header, and the second heat exchanger further has a second inlet header and a second outlet header. The first heat exchanger may include two of the eight rows of coil, the first inlet header is connected with and adapted to supply a heating working medium to the two rows of coil, and the first outlet header is connected with and adapted to collect the heating working medium from the two rows of coil. The second heat exchanger may include six of the eight rows of coil, the second inlet header is connected with and adapted to supply a cooling working medium to the six rows of coil, and the second outlet header is connected with and adapted to collect the cooling working medium from the six rows of coil.

In an embodiment, at least one panel is provided on the one of the sides of the cabinet. The at least one panel, which corresponds to where the blower, the motor and the filter are located, is removable for providing access to the blower, the motor and the filter from the one of the sides of the cabinet.

In another embodiment, the filter and the heat exchanger may be slanted with respect to the one of the sides of the cabinet at an angle of at or about 30° to at or about 60°. In an embodiment, the angle may be at or about 30° to at or about 45° and at or about 45° to at about 60°. In an embodiment, the angle is at or about 45°.

In another embodiment, the air inlet opening of the cabinet may further include a first air inlet opening provided in the one of the sides of the cabinet, and a second air inlet opening provided in another side of the cabinet. A user can select to use the first air inlet opening, the second air inlet opening or both.

The new AHU uses a heat exchanger and filter that are slanted with respect to one of the sides of its cabinet such that the major surface of the heat exchanger that conducts heat exchange faces the air flow that travels into the air flow path within the AHU from the air inlet opening of the cabinet. The inlet and outlet headers of the heat exchanger extend through the one of the sides of the cabinet. The major surface of the filter through which air flows into the air flow path faces the one of the sides of the cabinet and accessible from the same side. The drain pan is elevated from a bottom side of the cabinet and has a connection that also goes to the one of the sides of the cabinet. The blower and its motor are removable through the one of the sides of the cabinet of the AHU. These design parameters result in a reduced footprint and easy access of the AHU from the same side which improves installation and serviceability.

DRAWINGS

These and other features, aspects, and advantages of the AHU will become better understood when the following detailed description is read with reference to the accompanying drawing, wherein.

While the above-identified drawing figures set forth particular embodiments of the AHU, other embodiments are also contemplated, as noted in the discussion. In all cases, this disclosure presents illustrated embodiments of the AHU by way of representation and not limitation. Numerous other modifications and embodiments can be devised by those skilled in the art which fall within the scope and spirit of the principles of the AHU described herein.

DETAILED DESCRIPTION

Figure 1:
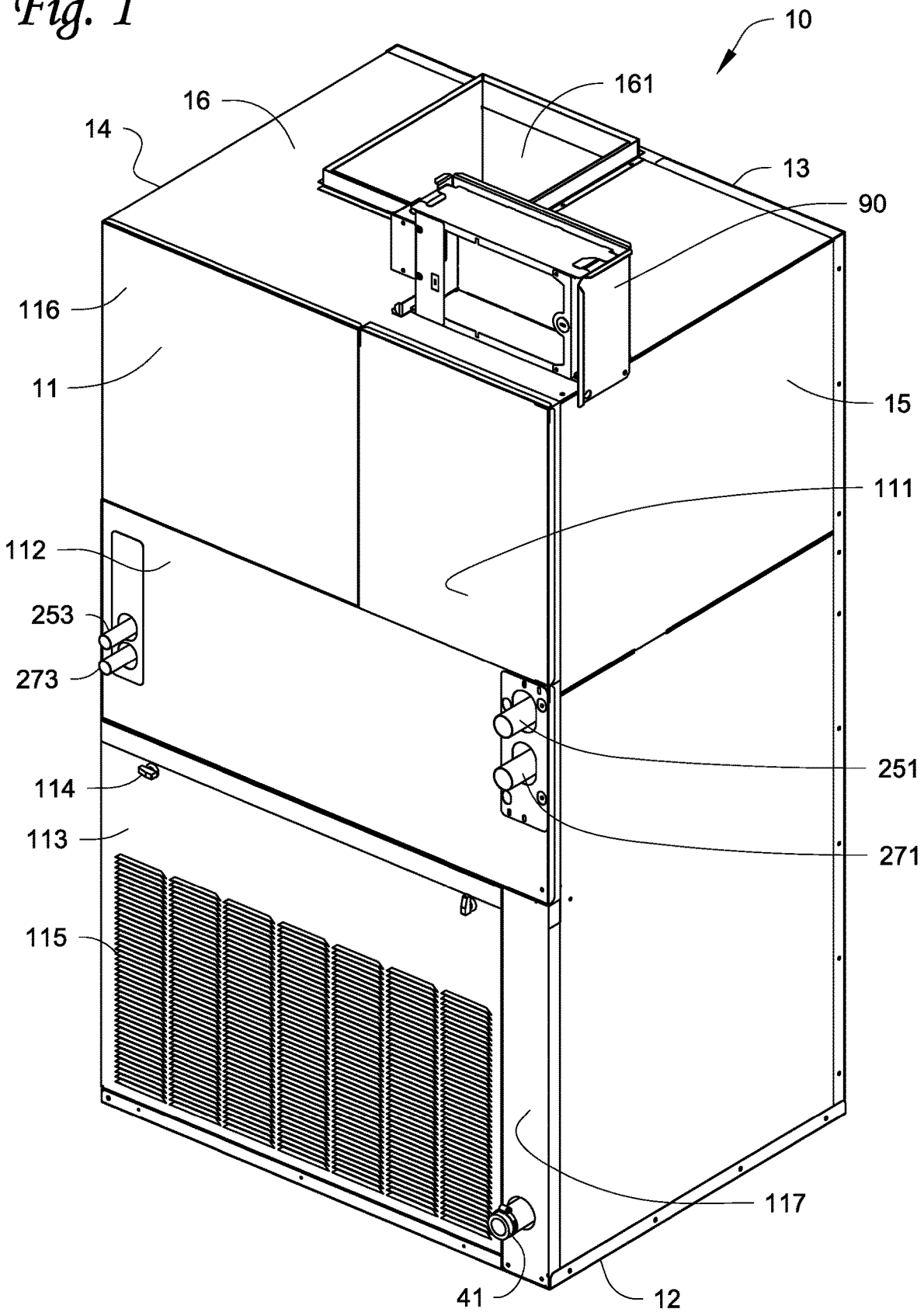
FIG. 1 is a front perspective view of an embodiment of an AHU.

An AHU with a reduced footprint and easy access is provided. FIG. 1 is a front perspective view of the AHU. The AHU has a cabinet which includes a first side 11, which is shown as the front side of the cabinet in FIG. 1; a second side 12, which is shown as the bottom side in FIG. 1; a third side 13, which is shown as the back side in FIG. 1; a fourth and fifth sides 14, 15, which are shown as left and right sides in FIG. 1; and a sixth side 16, which is shown as the top side in FIG. 1. The sides of the cabinet 10 are provided with panels. One or more panels can be provided on each side. In an embodiment, an air inlet opening 115 is provided on the first side 11. The air inlet opening 115 shown in FIG. 1 is provided with a louvered grill. In an embodiment, the louvered grill is provided on a second removable panel 113 provided on the first side 11, which will be detailed below. The air inlet opening 115 can also be connected with a duct. An air outlet opening 161 is provided on the sixth side 16. The air outlet opening 161 can also be connected to a duct. An air flow path is formed by the panels provided on the sides of the cabinet 10 for forcing air flow through the AHU between the air inlet opening 115 and the air outlet opening 161.

The AHU includes a heat exchanger 25, 27 and a blower 30 provided inside the cabinet 10, which will be further described in detail below with respect to FIG. 2. The heat exchanger 25, 27 includes an inlet header and an outlet header. The inlet header 251, 253 and the outlet header 271, 273 extend through the first side 11 for providing access to the inlet header 251, 253 and the outlet header 271, 273 from the first side 11. In an embodiment, the AHU includes a drain pipe 41 in fluid communication with a drain pan 40 mounted inside the cabinet 10. Condensate from the heat exchangers 25, 27 drops in the drain pan 40, and then is carried out of the AHU through the drain pipe 41. The structure of the drain pan 40 and the drain pipe 41 will be further described below. As shown in FIG. 1, the drain pipe 41 extends through a panel 117 of the first side 11. The drain pipe 41 may be connected with a drain line outside of the AHU for carrying the condensate to a proper place.

In some embodiments, one or more panels are provided on the first side 11 where some or all of the panels may be removable. In an embodiment, a panel 116 is provided on the first side 11. A blower 30, which is hidden in FIG. 1 and shown in FIG. 2, is disposed behind the panel 116. In an embodiment, a first removable panel 111, the position of which corresponds to where the motor 31 is located, is provided for a user or technician to access the motor 31 and the blower 30 by removing the first removable panel 111. With this arrangement, the blower 30 and the motor 31 are all accessible from the first side 11.

In an embodiment, a filter, which will be further described in detail below, is provided inside a second removable panel 113 of the cabinet shown in FIG. 1. A locking structure 114 is provided to lock the second removable panel 113. A user or a service technician can access the filter from the first side 11 by unlocking and removing the second removable panel 113 with the lock structure 114.

In an embodiment, a third panel 112, the position of which corresponds to where the heat exchangers 25, 27 are located, is provided. As shown in FIG. 1, the first and second inlet headers 251, 253, the first and second outlet headers 271, 273 extend through the third panel 112.

In an embodiment, the AHU may further include a control box 90 for containing controlling components such as controller board, wirings, sensors and input and output components. The control box 90 is disposed on the sixth side 16 and faces the first side 11 so that a user or a service technician can access the control box 90 from the first side 11.

Figure 2:
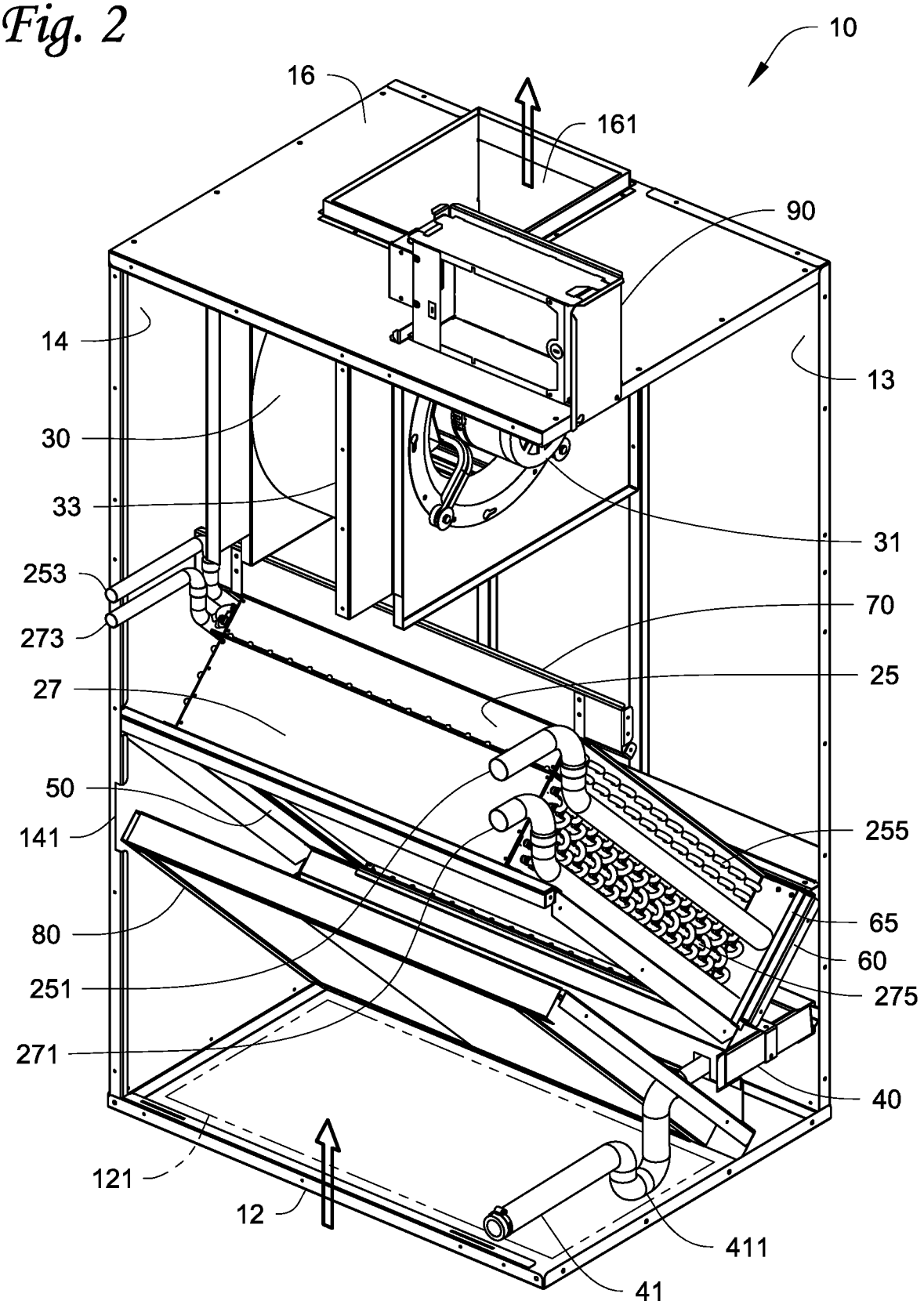
FIG. 2 is a perspective view of another AHU.
Figure 3:
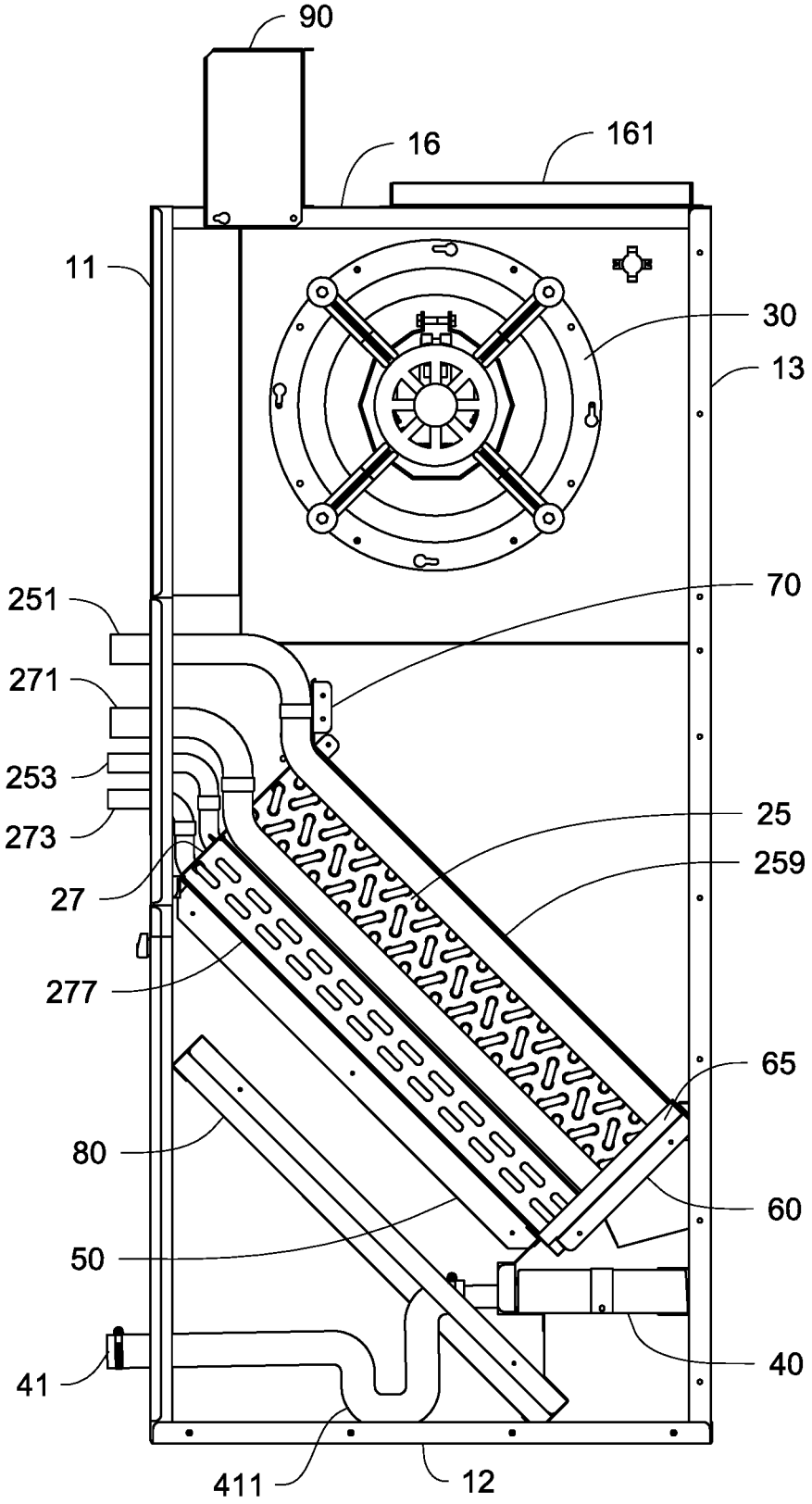
FIG. 3 is a side view of another AHU.

FIG. 2 is a perspective view of another AHU. FIG. 3 is a side view of another AHU. In an embodiment, the AHUs shown in FIGS. 2 and 3 can be the same as the AHU shown in FIG. 1. The cabinet 10 of the AHUs may include a first side 11, shown as the front side of the cabinet in FIG. 3; a second side 12, shown as the bottom side in FIGS. 2 and 3; a third side 13, shown as the back side in FIGS. 2 and 3; a fourth side 14 shown as the left side in FIG. 2; a fifth side, which is not marked up in FIGS. 2 and 3, is the right side of the cabinet in FIGS. 2 and 3; and a sixth side 16, shown as the top side in FIGS. 2 and 3. Panels on the first side 11 and the fifth side 15 are removed in FIG. 2 to illustrate the internal structure of the AHU. An air inlet opening 121 is provided on the second side 12, and an air outlet opening 161 is provided on the sixth side 16. Panels are provided on the sides forming an air flow path, which is shown with arrows in FIG. 2, for air flowing through the AHU between the air inlet opening 121 and the air outlet opening 161.

In an embodiment, the AHU comprises a heat exchanger 25, 27 and a blower 30. The heat exchanger 25, 27 is disposed in the air flow path and adapted to conduct heat exchange between air passing through the air flow path and a working medium flowing in the heat exchanger 25, 27. The heat exchanger 25, 27 includes an inlet header 251, 253 for supplying the working medium and an outlet header 271, 273 for collecting the working medium from the heat exchanger 25, 27. The heat exchanger 25, 27 is slanted with respect to one of the sides of the cabinet 10 such that the major surface of the heat exchanger 25, 27 that conducts heat exchange faces the air flow that travels into the air flow path within the AHU from the air inlet opening 121 of the cabinet. The inlet and outlet headers 251, 253, 271 and 273 of the heat exchanger 25, 27 extend through the one of the sides of the cabinet for providing access to the inlet header 251, 253 and the outlet header 271, 273 from the one of the sides of the cabinet. The first side 11 is shown as an example of the one of the sides in FIG. 2. The one of the sides of the cabinet 10 from which access to intended components of the AHU is available may be any side of the cabinet 10, and it will be appreciated that any side of the cabinet may be constructed with the panel configuration to give the access to the intended components of the AHU. The blower 30 is vertically disposed relative to the heat exchanger 25, 27 in the cabinet 10 for forcing air to flow through the air flow path.

In an embodiment, more than one heat exchanger may be used. Two heat exchangers 25, 27 which are stacked together in series are illustrated in FIGS. 2 and 3. In the AHU shown in FIG. 2, the first heat exchanger 27 can be used, for example, to cool air, and the second heat exchanger 25 can be used, for example, to heat the air. In the AHU shown in FIG. 3, the first heat exchanger 27 can be used, for example, to heat air, and the second heat exchanger 25 can be used, for example, to cool the air.

In an embodiment, a filter 80 is provided inside the cabinet 10. The major surface of the filter 80 through which air flows into the air flow path from the air inlet opening 115 faces the first side 11, e.g. the front side shown in FIG. 2. The air flow is filtered by the filter 80 before flowing to the heat exchangers 25, 27 and the blower 30.

Figure 4A:
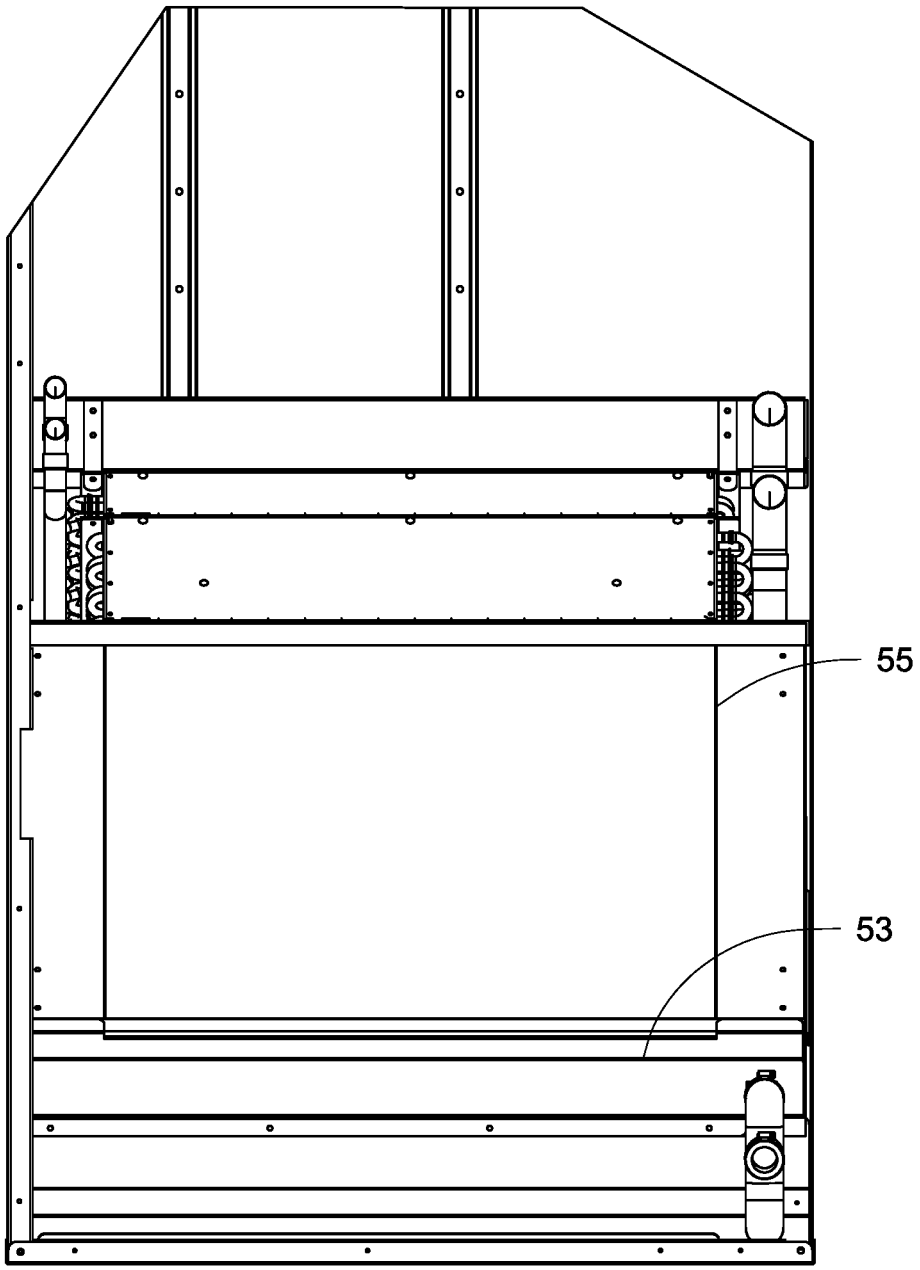
FIGS. 4A and 4B are partial views primarily showing a heat exchanger of the AHU in FIG. 2.
Figure 4B:
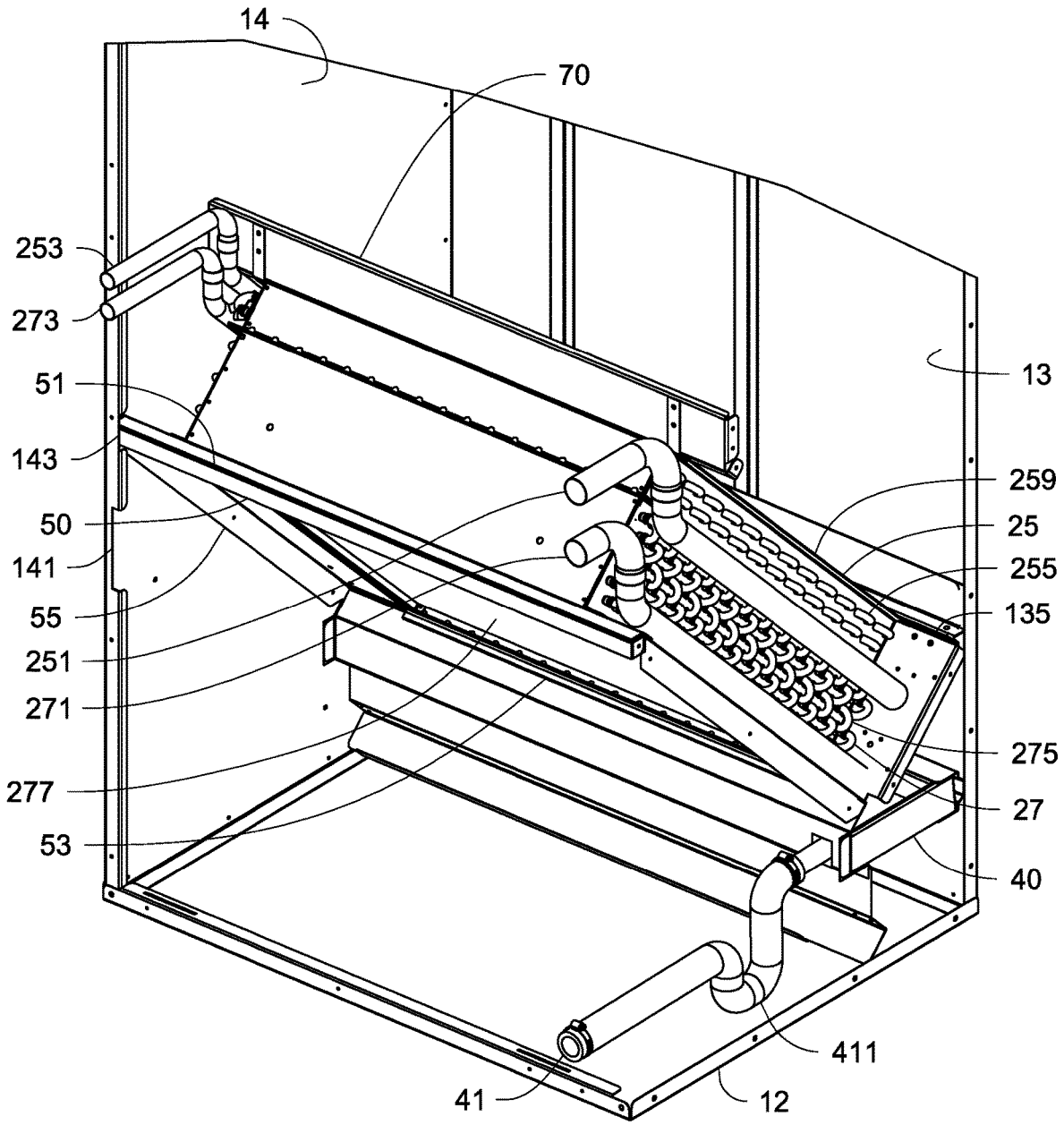

FIGS. 4A and 4B are partial views primarily showing a heat exchanger of the AHU in FIG. 2 using the example of two heat exchangers 25, 27. Panels provided on the first side 11 and the fifth side 15 are removed from FIG. 4B for illustrating the internal structure of the AHU. The construction and arrangement of the heat exchangers 25, 27 will be described in detail with reference to FIGS. 1, 2, 4A and 4B below.

In an embodiment, the first and second heat exchangers 27, 25 respectively include the first and second inlet headers 251, 253, first and second outlet headers 271 and 273, first rows of coil 275 and second rows of coils 255. The first and second inlet headers 251, 253 supply two working media, for example one cooling medium such as cold water and the other heating medium such as hot water from outside the AHU, to the first rows of coil 275 and the second rows of coil 255 separately. In an embodiment, the first rows of coil 275 and the second rows of coil 255 comprise a plurality of finned tubes for cooling and/or heating air surrounding the tubes. The first rows of coil 275 and the second rows of coil 255 are removable by removing the panel 112 shown in FIG. 1. The first and second outlet headers 271 and 273 collect the working media from the first rows of coil 275 and the second rows of coil 255 respectively for returning the working media.

Referring back to FIG. 1, in an embodiment, the first and second heat exchangers 27, 25 are oriented toward the first side 11 to allow the first and second inlet headers 251, 253 and the first and second outlet header 271, 273 to extend through the first side 11. In an embodiment, a fin and tube type heat exchanger is used as shown FIGS. 4A and 4B. In an embodiment, a microchannel heat exchanger can be used. In an embodiment, eight rows of coil can be accommodated in the AHU. For example, the first heat exchanger 27 may have an assembly of two rows of coil for heating air, and the second heat exchanger 25 may have an assembly of six rows of coil for cooling air.

In some embodiments, the two heat exchangers 25, 27 are stacked together in series in the cabinet 10 as shown in FIGS. 4A and 4B. The support components of the heat exchangers 25, 27 may include a first frame 50, a second frame 70 and a third frame 60.

In an embodiment, the first frame 50 is slanted with respect to the first side 11 of the cabinet at an angle from at or about 30° to at or about 60°. In another embodiment, the angle can be an angle of between at or about 30° to at or about 45°, and between at or about 45° to at or about 60°. In yet another embodiment, the angle is at or about 45°.

Referring to FIGS. 1 and 4B, a first end 51, e.g. the upper-front end of the first frame 50 with respect to the front side of the cabinet, is attached to the fourth side and the fifth side 14, 15. The top of the first frame 50 can be inserted into a groove 143 formed on the fourth side 14. A second end 53 of the first frame 50, e.g. the lower-back end of the first frame 50 with respect to the back side of the cabinet as shown in FIGS. 4A and 4B, is attached to the drain pan 40. In FIGS. 4A and 4B, the second end 53 is in the form of a rail attached to the drain pan 40. Other fastening mechanisms can also be used to attach the second end 53 to the drain pan 40. A third end 55 of the first frame 50, e.g. a left side end of the first frame 50 as shown in FIG. 4B, can be in the form of a rail, and is retained on the fourth side 14 shown in FIG. 4B. Similarly, the other end of the first frame 50 opposite to the third end 55, which is not shown in FIG. 4B, can also be retained on the fifth side 15. The front side 277 of the heat exchanger 25, 27 with respect to the front side of the cabinet as shown in FIGS. 3 and 4B, which is a major surface of the heat exchanger through which air flow travels and exchange heat with the working medium within the heat exchanger 25, 27 is supported by the first frame 50.

In an embodiment, the second frame 70 is in the form of a rail as shown in FIG. 4B, attached to the fourth side and the fifth side 14, 15 of the cabinet 10. The back side 259 of the heat exchangers 25, 27 with respect to the back side of the cabinet as shown in FIGS. 3 and 4B, is supported by the second frame 70. It should be noted that other supporting components at other locations can be used for securing the heat exchangers 25, 27 in the cabinet 10. In an embodiment, the heat exchangers 25, 27 are slanted with respect to the first side at an angle of at or about 30° to at or about 60°. In another embodiment, the angle may be at or about 30° to at or about 45° and at or about 45° to at or about 60°. In yet another embodiment, the angle is at or about 45°.

Figure 5:
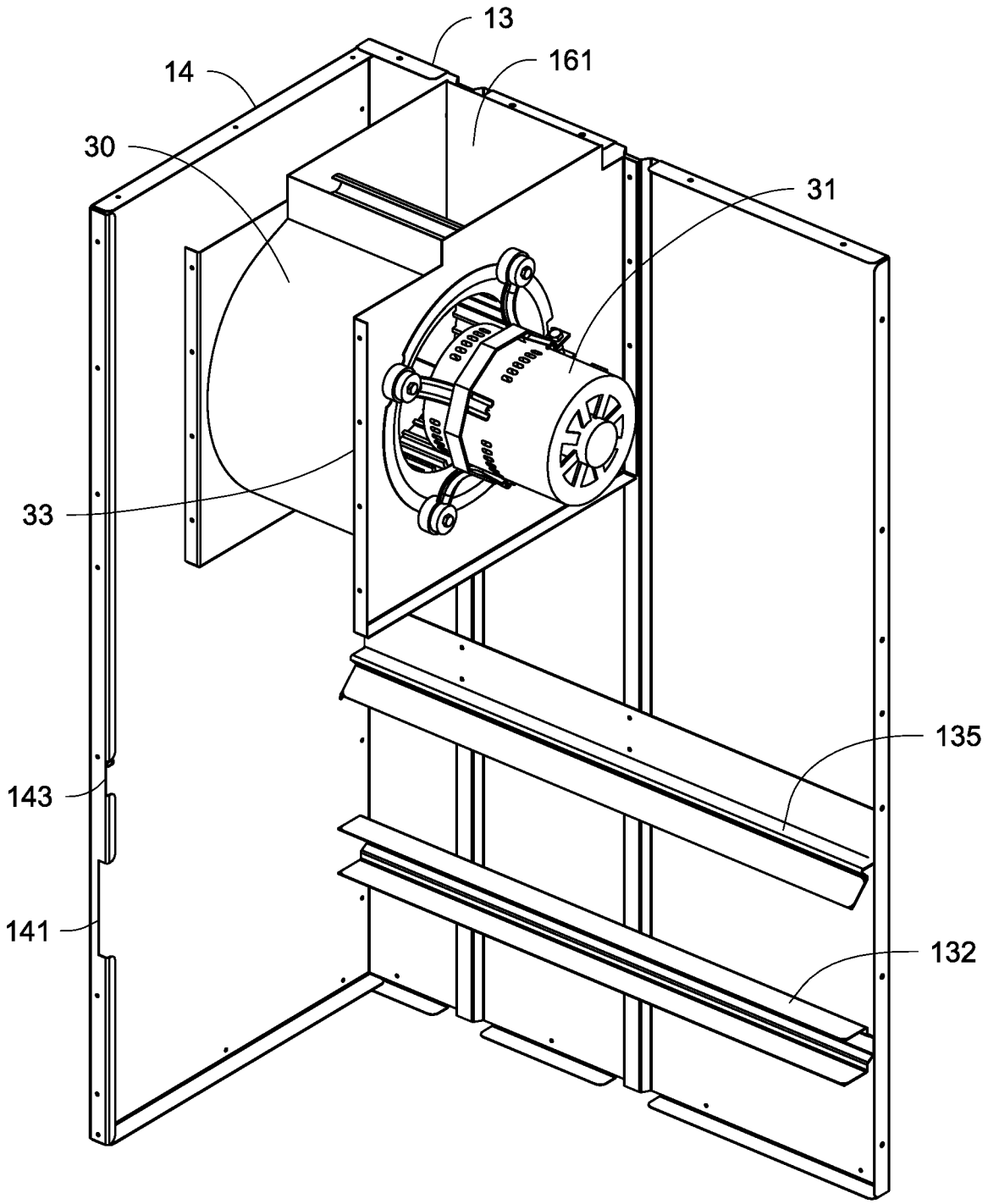
FIGS. 5 and 6 are partial views primarily showing a blower of the AHUs in FIGS. 2 and 3.
Figure 8:
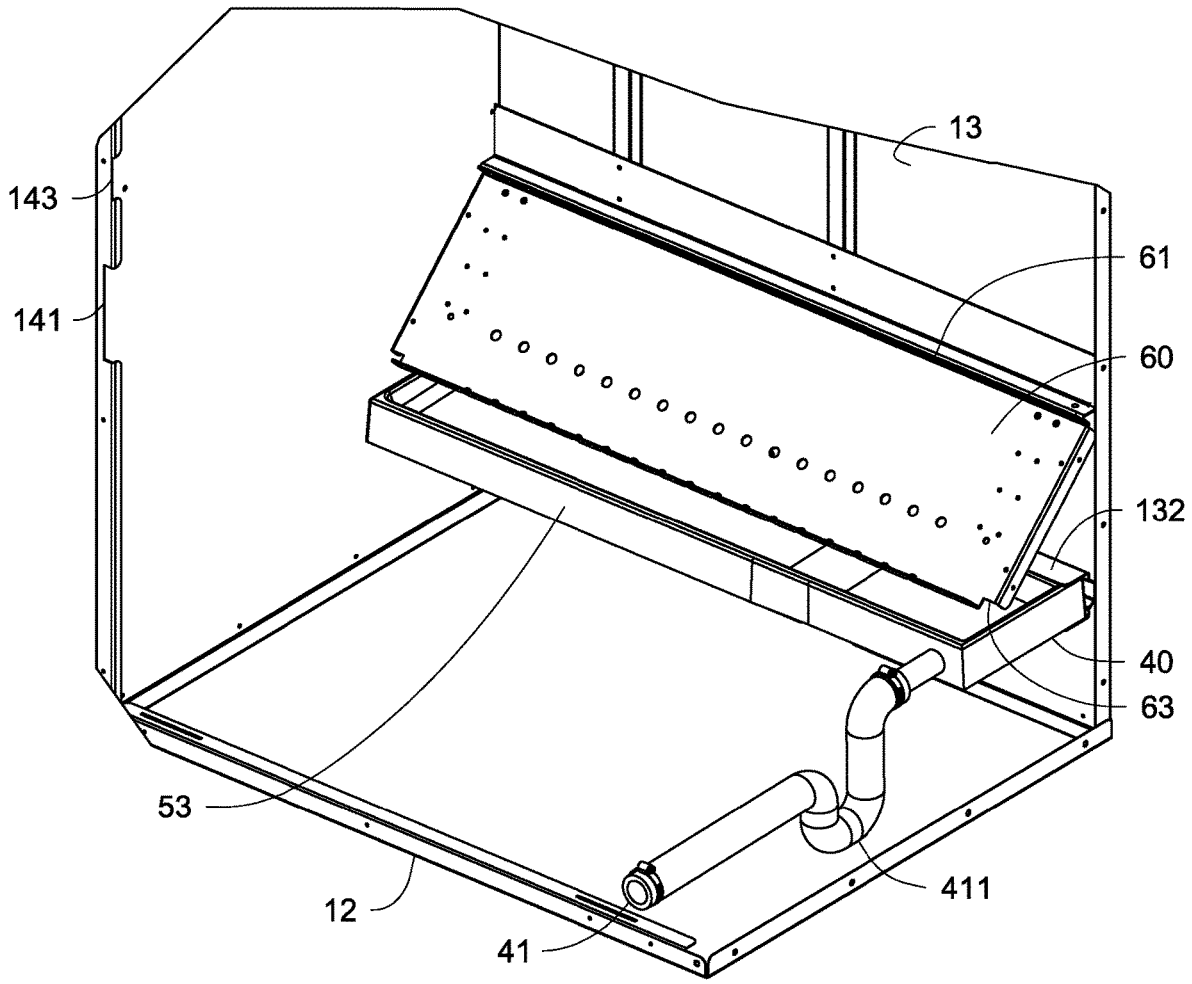
FIG. 8 is a partial view primarily showing a drain pan of the AHUs in FIGS. 2 and 3.

In an embodiment, referring to FIGS. 3 and 8, a third frame 60 slanted with respect to the third side 13 is further provided for suspending the heat exchanger 25, 27 above the drain pan 40. A first end 61 of the third frame 60, e.g. the top-back end of the third frame 60 with respect to the back side of the cabinet as shown in FIG. 8, is attached to the panel provided on the third side 13. A second end 63 of the third frame 60, e.g. the bottom-front end of the third frame 60 with respect to the bottom side as shown in FIG. 8, is suspended above the drain pan 40. The third frame 60 is attached to the fourth and the fifth sides 14, 15, for example via a flange, and is supported by the third side 13 via a first channel 135 which is shown in FIGS. 4B and 5. The bottom side of the heat exchanger 25, 27 with respect to the bottom side of the cabinet 10 is attached to the third frame 60. In an embodiment, a spacer 65 is provided on the third frame 60 for securing the heat exchanger 25, 27 as shown in FIG. 3.

Piping lines outside of the AHU such as the lines for supplying and collecting the working medium can be connected to the first and second inlet headers 251, 253 and the first and second outlet headers 271 and 273 through the first side. Users or service technicians can also access the first and second heat exchangers 27, 25 through the first side 11. Further, the heat exchangers 27, 25 slanted with respect to the first side 11 can be elevated from the second side 12, away from the second side 12 for a certain height as shown in FIGS. 2, 3 and 4B. This arrangement of the heat exchangers 27, 25 allows the cabinet 10 of the AHU to be installed directly on a ground floor, that is, the bottom side 12 can sit on the ground floor directly where the AHU sits. There is no need to provide such components as mounting legs or feet as in conventional AHUs for raising the heat exchanger 27, 25 and the drain pan 40 from the bottom side 12 for the purpose of producing a vertical space for accommodating a curved trap which extends down for a height from the drain pan 40 for draining off condensate from the drain pan 40.

Figure 6:
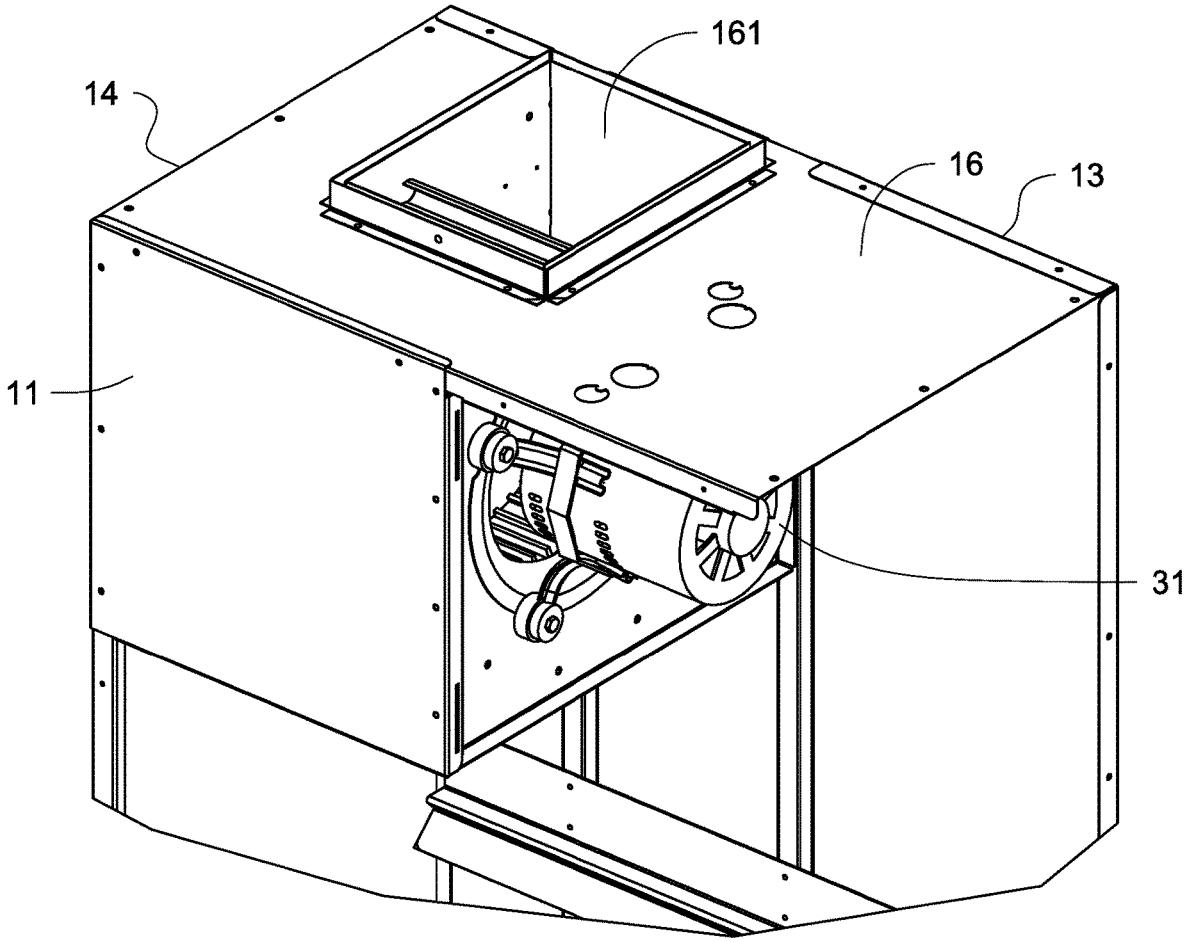

FIGS. 5 and 6 are partial views primarily showing a blower 30 of the AHUs in FIGS. 2 and 3. The blower 30 is vertically disposed relative to the heat exchanger in the air flow path of the AHU for forcing air to flow through the air flow path. The blower 30, powered by a driving motor 31, is secured in the cabinet 10 with the blower 30 attached to the panel 116 on the first side 11, which is shown in FIG. 1, via a spacer 33. The blower 30 can also be attached to the first removable panel 116 shown in FIG. 1 and the panels provided on the third side 13 directly. In this manner, it is easy for a user or a service technician to remove the first removable panel 111 and access the blower 30 to clean, repair and replace the blower 30 when necessary. FIG. 5 also shows the first channel 135 provided on the third side 13 for supporting the third frame 60 and a second channel 132 on the third side 13 for retaining the back of the drain pan 40.

In an embodiment, a motor 31 is provided for driving the blower 30. The motor 31 is also accessible from the first removable panel 111 as shown in FIG. 1. In this manner, it is easy for a user or a service technician to access the motor 31 to do service, repair and replacement from the first side 11.

Referring back to FIG. 2, the blower 30 and the motor 31 are vertically disposed relative to the heat exchanger 25, 27. In an embodiment, the blower 30 and the motor 31 are located over the heat exchanger 25, 27, i.e. downstream the heat exchangers 25, 27 in the air flow path. The AHU with this configuration is the so-called draw-through the AHU. The blower 30 and the motor 31 may also be located under the heat exchangers 25, 27, i.e. upstream of the heat exchangers 25, 27. The AHU with this configuration is the so-called blow-through AHU. The air flow direction from the bottom to the top shown in FIG. 2 is merely exemplary. Air may also flow into the cabinet 10 from the top side and the front side. Air may flow out of the cabinet 10 from the bottom side.

In an embodiment, the heat exchangers 25, 27 and the blower 30 are housed in one single cabinet 10 in one single volume by virtue of the fact that the heat exchangers 25, 27 are usually mounted in the same location. The heat exchangers are not housed in two or more separate cabinets or boxes as in conventional AHUs. The structure of the AHU is simplified with one single cabinet 10.

Figure 7:
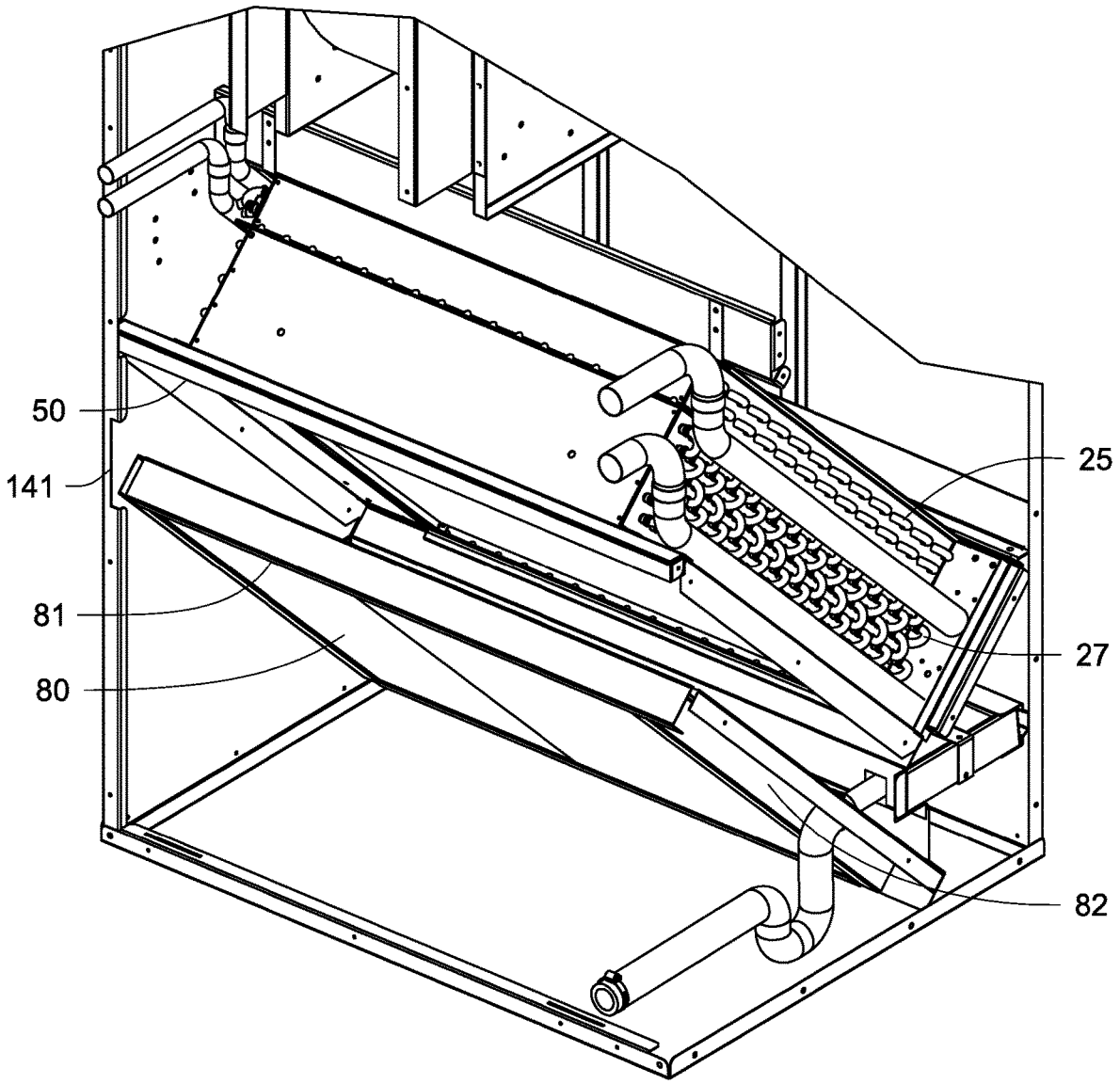
FIG. 7 is a partial view primarily showing a filter of the AHUs in FIGS. 2 and 3.

FIG. 7 is a partial view of filter 80 of the AHUs in FIGS. 2 and 3. In an embodiment, the filter 80 faces the first side and is slanted with respect to the first side at the same angle as the heat exchangers 25, 27, as shown in FIGS. 2 and 3. This angle can be any angle from at or about 30° to at or about 60°. For example, the angle can be an angle of between at or about 30° to at or about 45°, and between at or about 45° to at or about 60°. In an embodiment, the angle is at or about 45°.

The top front end of the filter 80 with respect to the first side 11 of the cabinet as shown in FIG. 7 can be removably inserted in a first groove 141 provided on the fourth side 14. In an embodiment, a second groove, which is not shown in FIG. 7, can also be provided on the fifth side 15 for supporting the other top front end of the filer 80. The front side of the filter 80 can be supported by the second removable panel 113 as shown in FIG. 1, for example through a top channel 81. The right side of the filter 80 is retained by a side channel 82 formed on the filter 80 attached to a right side panel of the cabinet (e.g. the fifth side 15), which is not shown in FIG. 7. The left side of the filter 80 can also be retained by another side channel formed on the filter 80 attached to a left side panel of the cabinet.

In an embodiment, the AHU may include a drain pan 40 in the cabinet 10 for collecting condensate generated in a cooling heat exchanger. FIG. 8 is a partial view showing a drain pan of the AHUs in FIGS. 2 and 3. Referring to FIGS. 2, 3 and 8, the drain pan 40 is located underneath the first and second coil 275, 255 and elevated at a height from the bottom side 12. The elevation height of the drain pan 40 is determined by the height of the drain trap in communication with the drain pan 40. The drain trap will be detailed below. As shown in FIG. 5, the panel provided on the third side 13 is provided with a channel 132 for retaining the back of the drain pan 40. In addition to the channel 132, brackets and frames other fasteners can also be used for attaching the drain pan 40 to the panel. The front of the drain pan 40 is held in place by a channel 53 as shown in FIGS. 4B and 8. Channel 53 is attached to the left side and the right side of the cabinet.

In an embodiment, the AHU includes a drain pipe 41 in communication with the drain pan 40 that extends through the first side 11. Referring back to FIG. 1, the drain pipe 41 can extend through the first side 11. Condensate from the heat exchangers 25, 27 drops in the drain pan 40, and then is carried out of the AHU through the drain pipe 41. The drain pipe 41 may be connected with a drain line outside of the AHU for carrying the condensate to a proper place.

In an embodiment, a drain pipe 41 of the AHU is provided with a curved trap 411 that is curved down from the drain pan 40 for a certain height within the cabinet for draining condensate. No pump is needed for draining the condensate out of the drain pan 40 with the curved trap 411. As mentioned above, with the heat exchangers 25, 27 slanted with respect to the first side 11 and the drain pan 40 elevated a distance above the bottom side, The cabinet 10 of the AHU with the curved trap 411 within the cabinet can be installed directly on a ground floor, that is, the bottom side of the cabinet 10 can sit on the ground floor directly where the AHU sits. There is no need to provide such components as mounting legs or feet to raise the heat exchanger from the bottom side 12 of the cabinet for the purpose of creating a vertical space for accommodating the curved trap 411.

The first side may be any side of the cabinet 10 such as the front side, the left side or the both sides of the cabinet 10. In an embodiment, the first side is a side of the cabinet 10 facing a space available in the application environment of the AHU (e.g. a closet) that is relatively larger than the space faced by other sides of the cabinet 10. A user or a service technician can access the heat exchanger 25, 27, the filter 80, the drain pan 40, the blower 30 and the motor 31 from the first side of the AHU. The space faced by the first side can also be employed for accommodating piping lines which are connected with the AHU and extending outside of it. When the first side faces a relatively larger space than other sides of the AHU, there is easier access to the components inside the AHU.

Figure 9:
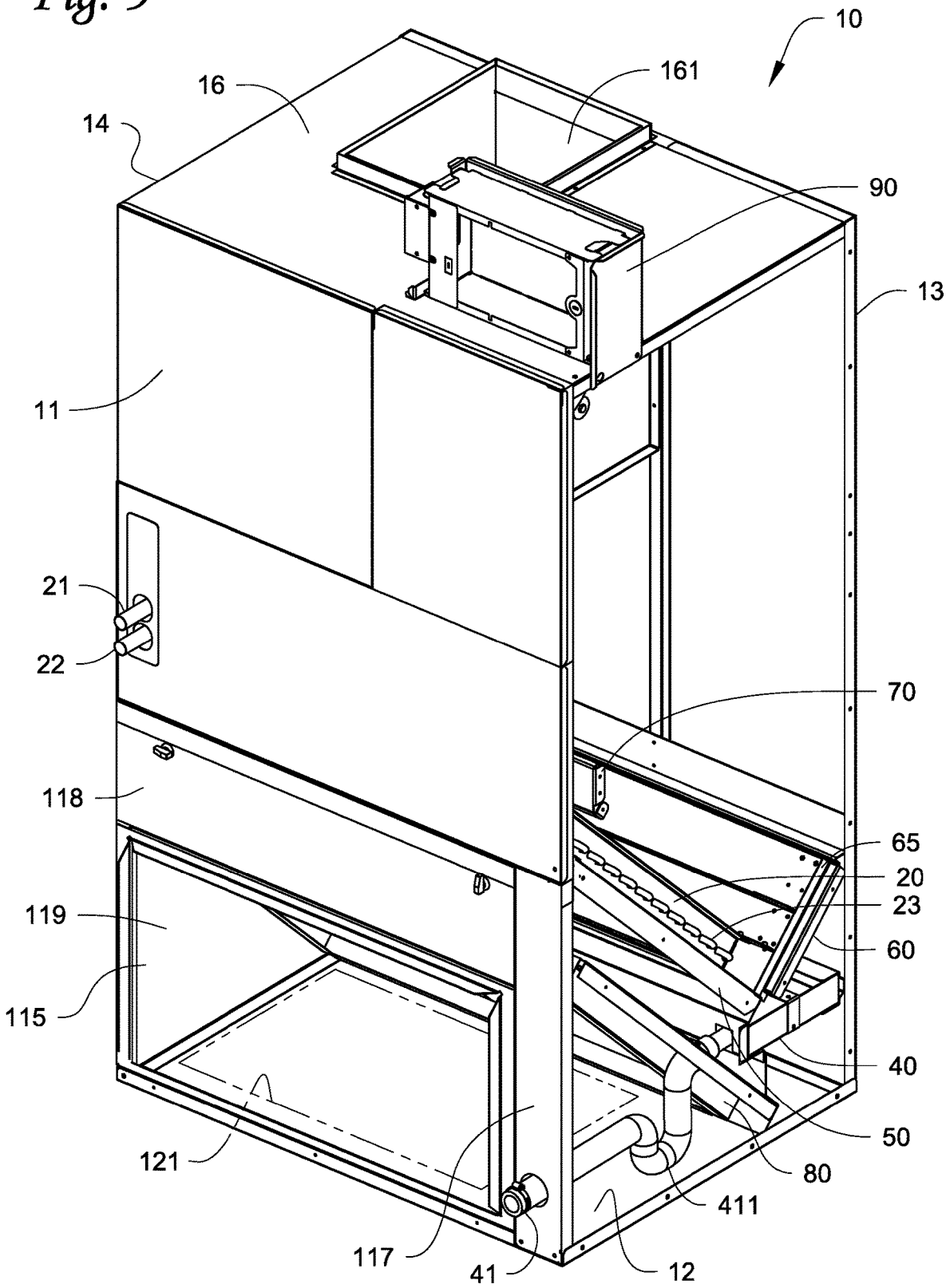
FIG. 9 is a perspective view of another AHU.
Figure 10:
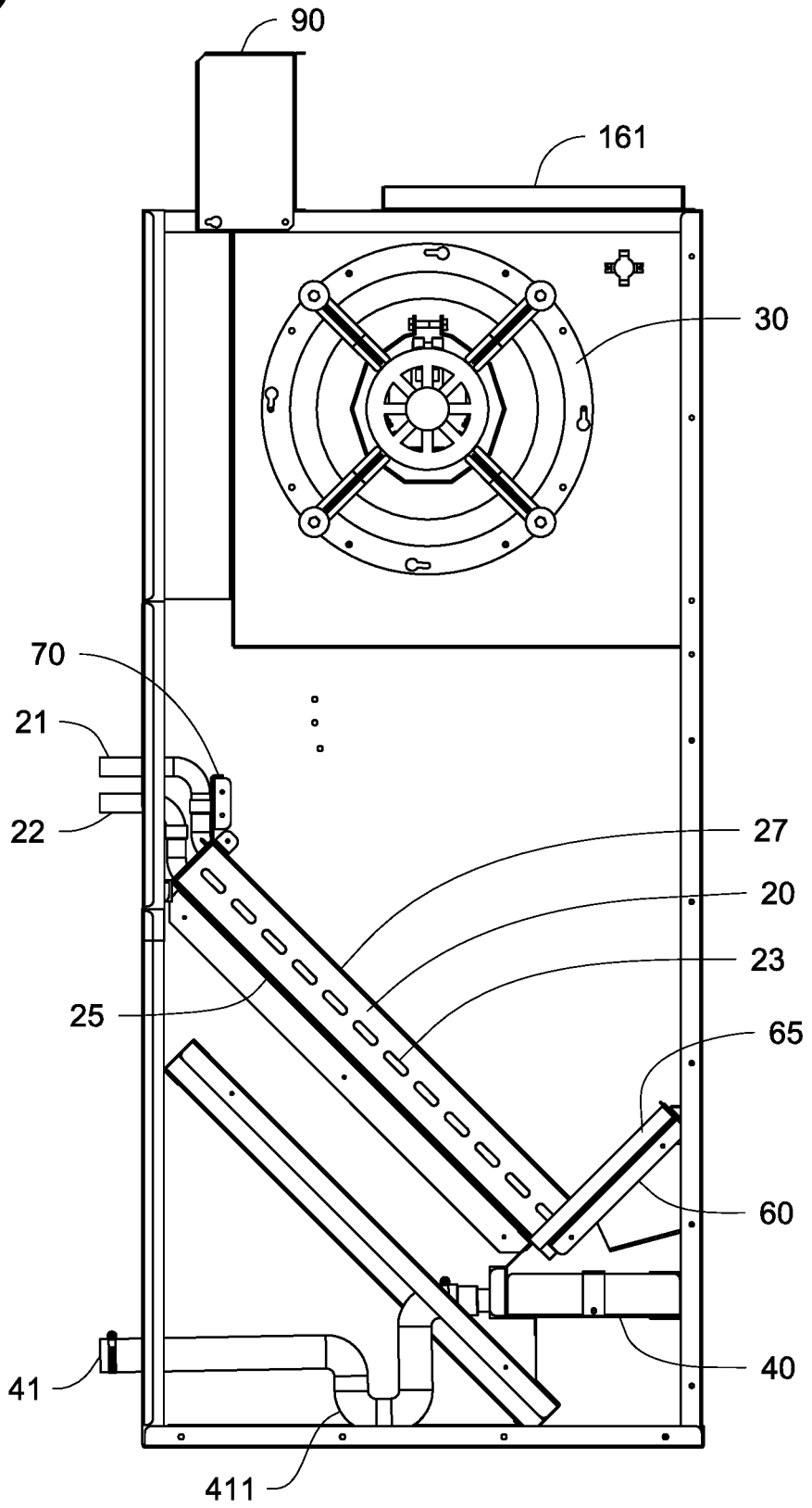
FIG. 10 is a side view of the AHU shown in FIG. 9.

FIG. 9 is a perspective view of another AHU. FIG. 10 is a side view of the AHU shown in FIG. 9. In an embodiment, one heat exchanger 20 is slanted with respect to one of the sides of the cabinet 10. The structure of the heat exchanger 20 is similar to the heat exchangers 25, 27 shown in FIGS. 2 and 3. The heat exchanger 20 includes an inlet header 21 and an outlet header 22 that extend through the first side 11. The heat exchanger 20 may include an assembly of one or more rows of coil 23. In an embodiment, the slanted arrangement of the heat exchanger 20 occupies less space than conventional heat exchangers which are vertically disposed. Thus, up to six rows of coil can be accommodated in the heat exchanger 20 (Only one row of coil 23 is schematically shown in FIGS. 9 and 10). In an embodiment, the heat exchanger 20 is supported by a first frame 50, a second frame 70 which is partially hidden behind the panels on the first side 11 in FIG. 9, and a third frame 60. The structure of the first frame 50, the second frame 70 and the third frame 60 is similar to the frames shown in FIG. 2. The coil 23 may also be attached to the panel provided on the third side 13 via a spacer 65.

In an embodiment, a drain pan 40 is provided beneath a cooling heat exchanger. A drain pipe 41 in fluid communication with the drain pan 40 extends through the first side 11. Referring to FIG. 9, in an embodiment, two air inlet openings are provided. The first air inlet opening 115 open for duct connection or a louvered grill for open air return is formed in a panel 119 on the first side 11, e.g. the front side as shown in FIG. 9. A second air inlet opening 121 open for duct connection or for a field supplied section such as a plenum is formed on the second side 12, e.g. the bottom side as shown in FIG. 9. A user enjoys the flexibility to choose to use the first air inlet opening 115, the second air inlet opening 121 or both to allow air to flow in the cabinet 10. This embodiment allows front air return, bottom air return or both. In another embodiment, a filter 80 is removably attached to a removable panel 118 on the first side 11. the filter 80 faces the first side 11, and the major surface of the filter 80 through which air flow from the first air inlet 115 or the second air inlet opening 121 travels to the air flow path within the cabinet is slanted with respect to the first side 11 at an angle of at or about 30° to at or about 60°. In an embodiment, the angle may be at or about 30° to at or about 45° and at or about 45° to at or about 60°. In yet another embodiment, the angle is at or about 45°.

The embodiments described herein advantageously provide an AHU. The new AHU uses a heat exchanger slanted with respect to one of the sides of the cabinet. A filter faces the one of the sides of the cabinet, is slanted with respect to the one of the sides and accessible from the same side. The slanted arrangement of the heat exchanger and the filter results in a reduced footprint of the AHU or allows more heat exchange elements (e.g. rows of coil) to be installed in the AHU to increase air conditioning capacity of the AHU. Up to eight rows of slanted coil can be accommodated in the AHUs in some embodiments of this invention, whereas no more than six rows of vertically-disposed coil are installed in conventional AHUs. The AHU also allows front air return, bottom air return or both. Thus, a user enjoys the flexibility of choosing air return direction.

Furthermore, the slanted arrangement of the heat exchanger allows the drain pan to be elevated above the bottom side of the cabinet to provide vertical space for an internal drain pan trap that curves down for a height. The AHU does not require mounting legs or feet for elevating it off the ground floor where the AHU is mounted. Thus, the bottom side of the cabinet can sit directly on the ground floor. The inlet and outlet headers of the heat exchanger extend through the one of the sides of the cabinet. The drain pan has a connection that goes to the same side. The filter, the blower and its motor are also accessible through the same side. The control box may also face the same side and is accessible from this side. The accessibility of the filter, blower, motor, heat exchanger and control box through the same side of the AHU facilitates installation, coil piping connection and drain line connection, and serviceability, including filter removal and replacement, drain pan cleaning or removal, the curved trap of the drain pipe cleaning, motor removal and replacement, blower cleaning, heat exchanger cleaning and removal.

While the embodiments have been described in terms of various specific embodiments, those skilled in the art will recognize that the embodiments can be practiced with modification within the spirit and scope of the claims.

What is claimed is:

1. An air handling unit, comprising:

a cabinet having an air inlet opening and an air outlet opening, the cabinet including panels provided on sides of the cabinet forming an air flow path for air flowing through the air handling unit between the air inlet opening and the air outlet opening;

a heat exchanger disposed in the air flow path and adapted to conduct heat exchange between air passing through the air flow path and a working medium flowing in the heat exchanger, the heat exchanger including an inlet header for supplying the working medium and an outlet header for collecting the working medium, wherein the heat exchanger is slanted with respect to one of the sides of the cabinet such that the inlet header and the outlet header extend through the one of the sides of the cabinet for providing access to the inlet header and the outlet header from the one of the sides of the cabinet, and the one of the sides of the cabinet is a front side of the cabinet, and the cabinet comprises a back side and opposing left side and right side between the front side and the back side;

a blower vertically disposed relative to the heat exchanger in the cabinet for forcing air to flow through the air flow path; and a first frame slanted with respect to the front side, wherein a first end of the first frame is removably attached to the left side and the right side of the cabinet, and a second end of the first frame is removably attached to a drain pan, and a front side of the heat exchanger with respect to the front side of the cabinet is supported by the first frame.

2. The air handling unit according to claim 1, the air handling unit further comprising a control box that is disposed facing the one of the sides of the cabinet such that the control box is accessible from the one of the sides of the cabinet.

3. The air handling unit according to claim 1, wherein the heat exchanger and the blower are housed in one single cabinet that is one volume.

4. The air handling unit according to claim 1, the heat exchanger comprising eight rows of coil, and is in the form of a first heat exchanger and a second heat exchanger, the first heat exchanger further comprising a first inlet header and a first outlet header, the second heat exchanger further comprising a second inlet header and a second outlet header, wherein the first heat exchanger includes two of the eight rows of coil, the first inlet header is connected with and adapted to supply a heating working medium to the two rows of coil, and the first outlet header is connected with and adapted to collect the heating working medium from the two rows of coil; and the second heat exchanger includes six of the eight rows of coil, the second inlet header is connected with and adapted to supply a cooling working medium to the six rows of coil, and the second outlet header is connected with and adapted to collect the cooling working medium from the six rows of coil.

5. The air handling unit according to claim 1, the air inlet opening further comprising:

a first air inlet opening provided in the one of the sides of the cabinet; and a second air inlet opening provided in another side of the cabinet.

6. The air handling unit according to claim 1, wherein the drain pan is in the cabinet and elevated from a bottom side of the cabinet for collecting condensate generated in the heat exchanger, and the air handling unit further comprises a drain pipe in fluid communication with the drain pan that extends through the one of the sides of the cabinet.

7. The air handling unit according to claim 6, the drain pipe further comprising a curved trap within the cabinet that is curved down for a height from the drain pan.

8. The air handling unit according to claim 1, wherein the first end of the first frame is an upper front end with respect to the front side of the cabinet, and the second end of the first frame is a lower back end with respect to the back side of the cabinet.

9. The air handling unit according to claim 8, the air handling unit further comprising:

a second frame attached to the left side and/or right side, wherein a back side of the heat exchanger with respect to the back side of the cabinet is supported by the second frame.

10. The air handling unit according to claim 9, the air handling unit further comprising a third frame for suspending the heat exchanger above the drain pan, wherein the third frame is slanted with respect to the bottom side of the cabinet.

11. The air handling unit according to claim 10, the heat exchanger further comprising eight rows of coil.

12. The air handling unit according to claim 1, the air handling unit further comprising a motor for driving the blower, wherein the blower and the motor are accessible from the one of the sides of the cabinet.

13. The air handling unit according to claim 12, the air handling unit further comprising a filter disposed in the air flow path through which air flows before flowing to the heat exchanger and the blower, wherein the filter faces the one of the sides of the cabinet, and the filter is accessible from the one of the sides of the cabinet.

14. The air handling unit according to claim 13, wherein at least one panel is provided on the one of the sides of the cabinet, the at least one panel which corresponds to where the blower, the motor and the filter are located is removable for providing access to the blower, the motor and the filter from the one of the sides of the cabinet.

15. The air handling unit according to claim 13, wherein the filter and the heat exchanger are oriented toward the one of the sides of the cabinet at an angle of at or about 45°.

* * * * *